US008707748B2

(12) United States Patent
Fiorucci

(10) Patent No.: US 8,707,748 B2
(45) Date of Patent: Apr. 29, 2014

(54) TURN DOWN APPARATUS

(75) Inventor: Keith Fiorucci, Sturbridge, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 863 days.

(21) Appl. No.: 12/828,545

(22) Filed: Jul. 1, 2010

(65) Prior Publication Data

US 2012/0000959 A1 Jan. 5, 2012

(51) Int. Cl.
*B21D 11/00* (2006.01)
*B21B 39/20* (2006.01)

(52) U.S. Cl.
USPC ..... 72/66; 72/250

(58) Field of Classification Search
USPC ..... 72/64, 66, 135, 127, 149, 157, 230, 72/250, 251; 242/250, 361; 226/196.1
See application file for complete search history.

(56) References Cited

U.S. PATENT DOCUMENTS

| | | | | | |
|---|---|---|---|---|---|
| 1,655,845 | A | * | 1/1928 | Roof | 72/66 |
| 1,948,763 | A | * | 2/1934 | Koch | 314/69 |
| 2,099,459 | A | * | 11/1937 | Bannister | 72/97 |
| 2,591,943 | A | * | 4/1952 | Kitselman | 72/145 |
| 2,700,907 | A | * | 2/1955 | Durst | 29/238 |
| 3,230,759 | A | * | 1/1966 | Schoenfeld et al. | 72/467 |
| 3,398,566 | A | * | 8/1968 | Garvey | 72/250 |
| 3,446,052 | A | * | 5/1969 | Cetrone et al. | 72/250 |
| 3,596,706 | A | | 8/1971 | Knorr et al. | |
| 3,610,498 | A | | 10/1971 | Gilvar | |
| 3,680,758 | A | | 8/1972 | Kinnicutt, Jr. | |
| 3,761,003 | A | | 9/1973 | Sieurin | |
| 3,777,964 | A | | 12/1973 | Kruner et al. | |
| 3,914,972 | A | * | 10/1975 | Gillette et al. | 72/212 |
| 3,948,613 | A | | 4/1976 | Weill | |
| 4,074,553 | A | * | 2/1978 | Woodrow | 72/66 |
| 4,212,178 | A | * | 7/1980 | Bretschneider | 72/97 |
| 4,242,892 | A | * | 1/1981 | Wykes et al. | 72/66 |
| 4,325,244 | A | * | 4/1982 | Stowe et al. | 72/158 |
| 4,413,494 | A | * | 11/1983 | Gilvar et al. | 72/167 |
| 4,766,794 | A | * | 8/1988 | Blake | 83/847 |
| 5,050,416 | A | * | 9/1991 | Gobin et al. | 72/38 |
| 5,154,688 | A | * | 10/1992 | Boyd | 493/459 |
| 5,343,934 | A | | 9/1994 | Wilson | |
| 5,687,603 | A | * | 11/1997 | Coppenolle | 72/250 |
| 5,839,684 | A | * | 11/1998 | Poloni et al. | 242/361 |

(Continued)

FOREIGN PATENT DOCUMENTS

| | | | | |
|---|---|---|---|---|
| DE | 3638333 A1 | * | 5/1988 | B21B 39/16 |
| EP | 0940195 A2 | | 9/1999 | |
| EP | 1640566 A1 | * | 3/2006 | F01L 1/26 |

OTHER PUBLICATIONS

PCT International Search Report mailed Nov. 2, 2011 corresponding to PCT International Application No. PCT/US2011/041066 filed Jun. 20, 2011 (10 pages).

*Primary Examiner* — Edward Tolan

(57) ABSTRACT

A turn down apparatus is disclosed for guiding a hot rolled product moving along a downwardly curved path. The apparatus comprises a stationary support structure having an open bottomed channel following the contour of the curved path. The channel has a top surface overlying the path, sides extending downwardly from the top surface, and ledges projecting inwardly from the sides. Wear resistant inserts are affixed in place in the channel. The inserts are arranged to line the top surface of the channel, with sides of the inserts overlapping the inwardly projecting ledges, and with the lengths of the inserts defining chords of the curved path.

8 Claims, 3 Drawing Sheets

(56) References Cited

U.S. PATENT DOCUMENTS

| | | | | |
|---|---|---|---|---|
| 5,934,536 | A * | 8/1999 | Shore et al. | 226/177 |
| 6,123,461 | A | 9/2000 | Wojtkowski, Jr. | |
| 6,769,641 | B2 * | 8/2004 | Pariseau et al. | 242/361 |
| 7,076,982 | B2 * | 7/2006 | Coop | 72/149 |
| 7,401,491 | B2 * | 7/2008 | Leland | 72/413 |
| 8,016,224 | B2 * | 9/2011 | Bandholz et al. | 242/615.3 |
| 2005/0183892 | A1 * | 8/2005 | Oldham et al. | 175/402 |
| 2008/0135659 | A1 * | 6/2008 | Condon et al. | 241/274 |
| 2009/0121064 | A1 * | 5/2009 | Poloni et al. | 242/361 |

* cited by examiner

TURN DOWN APPARATUS

FIELD OF THE INVENTION

This invention relates to rolling mills producing hot rolled rods, bars and the like, and is concerned in particular with an apparatus for guiding such products along curved paths.

BACKGROUND DISCUSSION

In a conventional rolling mill, the hot rolled product, e.g., 5.5 mm rod, can exit the last finishing stand at a speed exceeding 100 m/sec. The rod is then guided by an apparatus commonly referred to as a "turn down" along a downwardly curved path into a laying head. The laying head forms the rod into rings which are received on a conveyor where they are subjected to controlled cooling as they are transported to a reforming station.

Conventional turn downs typically employ fixed curved surfaces to guide the products downwardly along the curved paths. A drawback with this arrangement is that such guide surfaces are rapidly eroded by frictional contact with the hot products, thus requiring frequent mill stoppages after only several hours of operation in order to replace worn components.

The objective of the present invention is to provide a turn down apparatus with improved resistance to wear, thus enabling mills to operate continuously for extended periods of time measured in days rather than hours.

SUMMARY OF THE INVENTION

A turn down apparatus in accordance with the present invention comprises a stationary support structure having an open bottomed channel following the contour of a downwardly curved path along which the hot rolled product is to be guided. The channel is defined by a top surface overlying the curved path, with sides extending downwardly from the top surface, and with ledges projecting inwardly from the sides. Wear resistant inserts are affixed in the channel. The inserts are arranged to line the top surface of the channel, with sides of the inserts overlapping the channel ledges, and with lengths of the inserts defining chords of the curved path.

In order to present a guide surface to the product that approximates the curvature of the curved path, the lengths of the inserts are kept to a minimum, advantageously between about 0.1-1.0% of the radius of the curved path.

The stationary support structure may comprise a conventional steel fabrication, and the wear resistant inserts may comprise tungsten carbide tiles affixed in place. Preferably, the tiles are bonded to the top surface, sides and ledges of the channel, with brazing being a preferred method of bonding.

These and other features and attendant advantages of the present invention will now be described in further detail by reference to the accompanying drawings, wherein:

DETAILED DESCRIPTION

Figure 1:
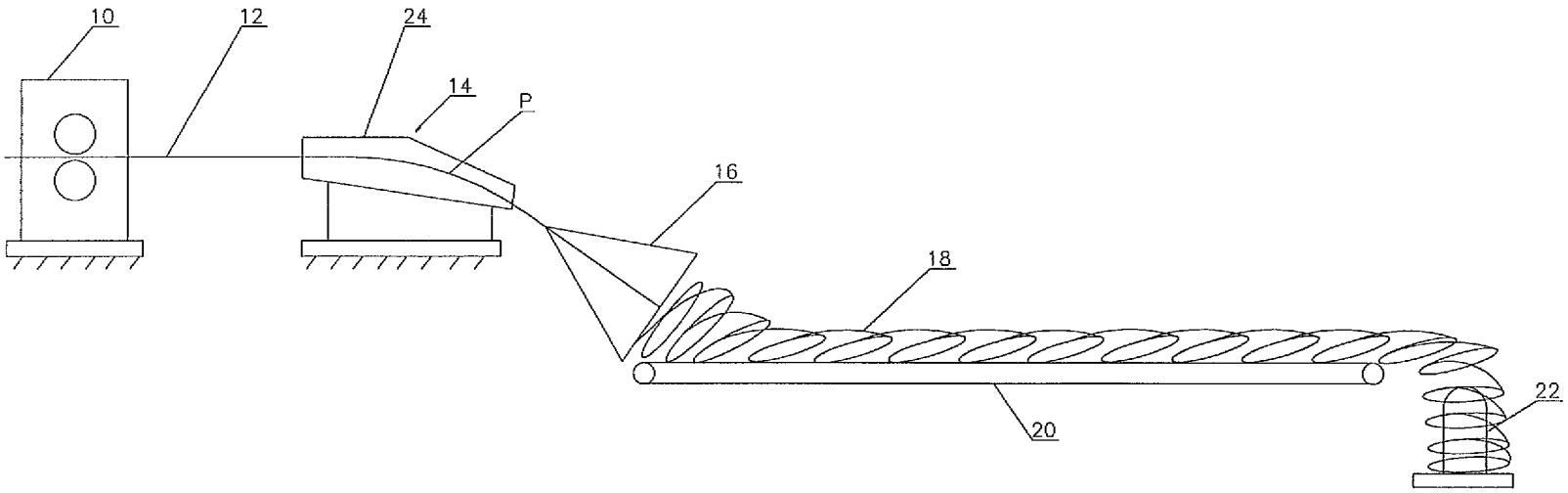
FIG. 1 is a schematic illustration of the delivery end of a rolling mill employing a turn down apparatus in accordance with the present invention.
Figure 2:
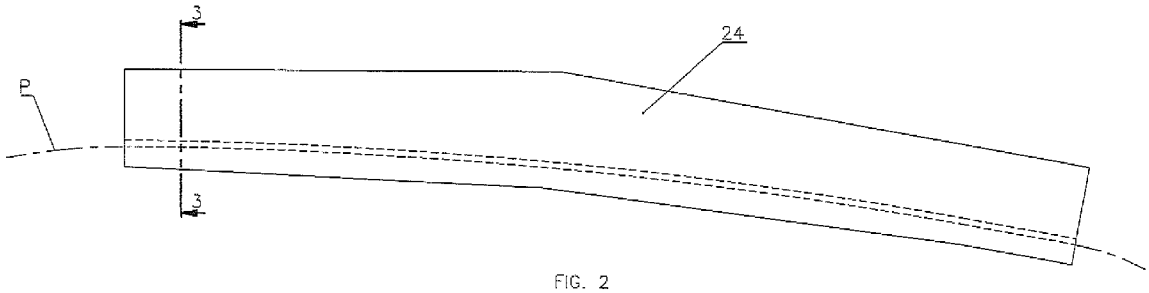
FIG. 2 is an enlarged side view of the plate forming part of the stationary support structure of the turn down apparatus.
Figure 3:
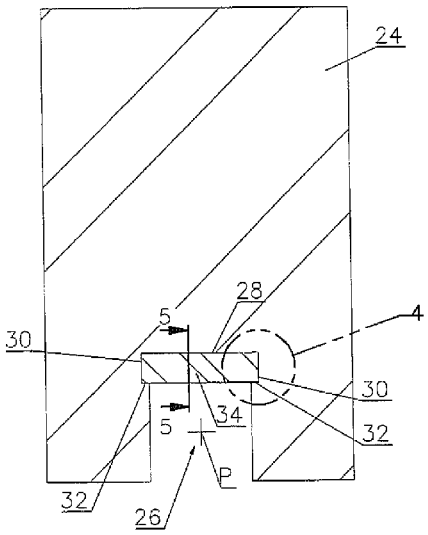
FIG. 3 is a sectional view taken along line 3-3 of FIG. 2.
Figure 4:
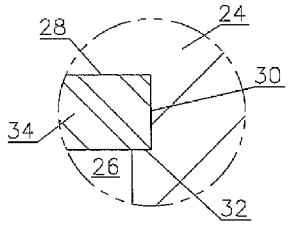
FIG. 4 is an enlarged view of the circled area shown in FIG. 3.
Figure 5:
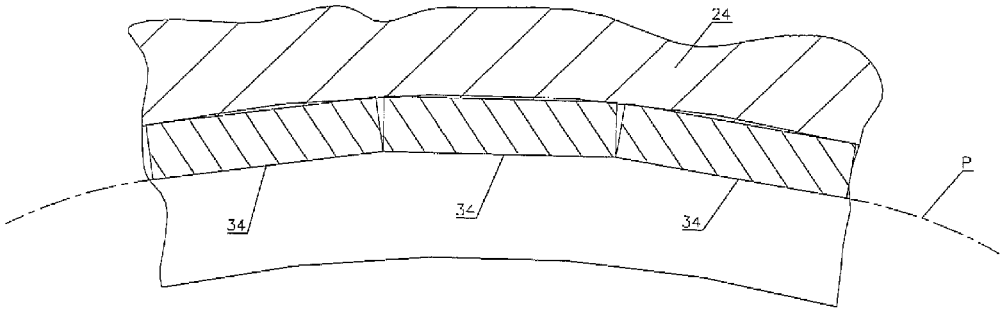
FIG. 5 is a sectional view taken along line 5-5 of FIG. 3.

With reference initially to FIG. 1, the last roll stand of a rolling mill is shown at 10. Hot rolled product 12, typically 5.5 mm rod traveling at speeds in excess of 100 m/sec., exits roll stand 10 and is guided along a downwardly curved path "P" by a turn down apparatus 14 in accordance with the present invention. The rod is directed to a laying head 16 where it is formed into rings 18 received on a conveyor 20 where they are subjected to controlled cooling while being transported to a reforming station 22.

With reference additionally to FIGS. 2-5, it will be seen that the turn down apparatus includes a stationary structure including a plate 24 with an open bottomed channel 26 following the contour of path P.

The channel 26 has a top surface 28 overlying the path P, sides 30 extending downwardly from the top surface, and ledges 32 projecting inwardly from the sides 30.

Figure 6:
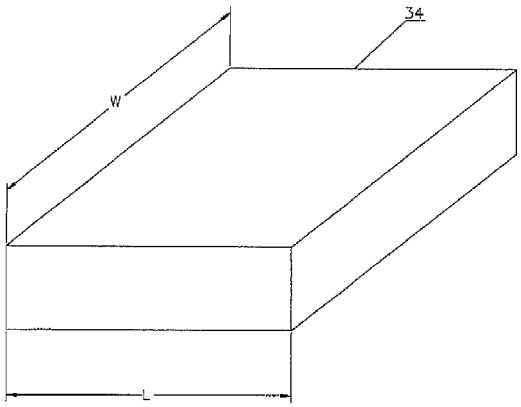
FIG. 6 is a perspective view of a wear resistant insert.
Figure 7:
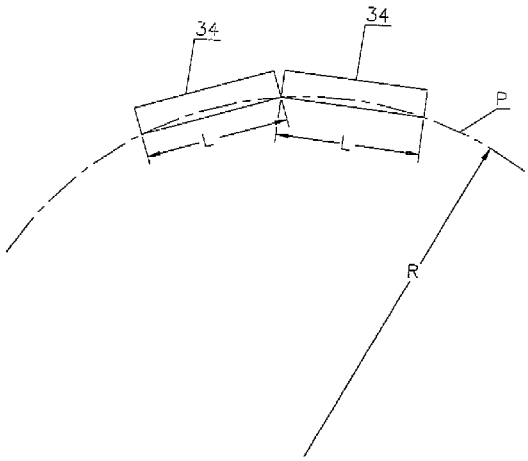
FIG. 7 is a diagrammatic depiction showing the lengths of the inserts as chords of the guide path curvature, with the curvature of the path and the dimensions of the inserts exaggerated for purposes of illustration.

Wear resistant inserts 34 are arranged end to end in the channel. As shown in FIG. 6, the inserts 34 may be substantially planar and rectangular, with widths "W" and lengths "L". The inserts are arranged to line the top surface 28 of the channel 26. The widths W of the inserts are dimensioned such that sides of the inserts overlap the ledges 32 of the channel. As depicted diagrammatically in FIG. 7, the lengths L of the inserts define chords of the path P. As noted previously, the lengths L are kept to a minimum, advantageously between about 0.1-1.0% of the radius R of the curved path P.

In a preferred embodiment of the invention, the inserts 34 comprise tiles made of tungsten carbide or other wear resistant materials. The tiles are preferably affixed in place within the channel 26 by being bonded to the top surface 28, the sides 30 and the ledges 32. Bonding is preferably achieved by brazing.

The overlap of the insert sides on the ledges 32 provides a secure mechanical interlock which insures that the inserts remain in place in the channel, even in the event that the bonded interfaces are disrupted during mill operation.

As a product passes downwardly along path P, forces resulting from the change in direction urge it into contact with the wear resistant inserts 34 lining the top surface 28 of the channel 26. The enhanced wear resistance of the inserts enables the turn down apparatus to operate for extended periods of time, thus contributing advantageously to efficient operation of the mill.

I claim:

1. A turn down apparatus for guiding a hot rolled product moving along a downwardly curved path, comprising:

a stationary support structure having an open bottomed channel extending continuously along the contour of said path, said channel having a top surface overlying said path, sides extending downwardly from said top surface on opposite sides of said path, and ledges projecting inwardly from said sides; and wear resistant inserts affixed in place in said channel, said inserts being arranged end to end to line said top surface, with sides of said inserts overlapping said ledges, and with lengths of said inserts defining successive chords of said path.

2. The turn down apparatus of claim 1 wherein said wear resistant inserts comprise tungsten carbide tiles.

3. The turn down apparatus of claim 2 wherein said wear resistant inserts are bonded in place.

4. The turn down apparatus of claim 3 wherein said inserts are bonded to the top surface, sides and ledges of said channel.

5. The turn down apparatus of claim 3 wherein said inserts are bonded by brazing.

6. The turn down apparatus of claim 4 wherein said inserts are bonded by brazing.

7. A turn down apparatus for guiding a hot rolled product moving along a downwardly curved path, comprising:

a stationary support structure having an open bottomed channel following the contour of said path, said channel having a top surface overlying said path, sides extending downwardly from said top surface, and ledges projecting inwardly from said sides; and wear resistant tungsten carbide inserts bonded to the top surface, sides and ledges of said channel, said inserts having lengths equal to between about 0.1-1.0% of the radius of said curved path and being arranged to line said top surface, with sides of said inserts overlapping said ledges, and with lengths of said inserts defining chords of said path.

8. A turn down apparatus for guiding a hot rolled product moving along a downwardly curved path, comprising:

a stationary support structure having an open bottomed channel following the contour of said path, said channel having a top surface overlying said path, sides extending downwardly from said top surface, and ledges projecting inwardly from said sides; and wear resistant inserts affixed in place in said channel, said inserts being arranged to line said top surface, with sides of said inserts overlapping said ledges, and with lengths of said inserts defining chords of said path, said wear resistant inserts having lengths equal to between about 0.1-1.0% of the radius of said curved path.

* * * * *